US006526721B1

(12) United States Patent
Nash

(10) Patent No.: US 6,526,721 B1
(45) Date of Patent: Mar. 4, 2003

(54) FLUID-IMPERVIOUS BARRIER/KEYWAY FORM SUPPORT APPARATUS, SYSTEM AND RELATED METHOD

(76) Inventor: Brian D. Nash, 623 Blue Sky Pkwy., Lexington, KY (US) 40509

( * ) Notice: Subject to any disclaimer, the term of this patent is extended or adjusted under 35 U.S.C. 154(b) by 0 days.

(21) Appl. No.: 09/579,756

(22) Filed: May 26, 2000

(51) Int. Cl.[7] ..... E04C 5/16; E04C 5/18; E04B 1/38

(52) U.S. Cl. ..... 52/677; 52/699; 52/712; 52/295; 52/741.4; 52/741.41; 248/302; 264/35; 249/213

(58) Field of Search ..... 52/396.02, 677, 52/712, 741.4, 741.41, 294, 295, 699; 248/302, 339, 63; 264/31, 35; 249/213, 210

(56) References Cited

U.S. PATENT DOCUMENTS

| | | | | | |
|---|---|---|---|---|---|
| 383,092 | A | * | 5/1888 | Baker | |
| 1,273,073 | A | | 7/1918 | Lake | |
| 1,662,645 | A | * | 3/1928 | Lampert | |
| 2,020,407 | A | * | 11/1935 | Forster | |
| 2,296,391 | A | | 9/1942 | Marchant | |
| 2,698,560 | A | | 1/1955 | Heltzel | |
| 2,701,702 | A | * | 2/1955 | Diederich | |
| 2,902,167 | A | * | 9/1959 | Smith | |
| 2,998,216 | A | | 8/1961 | Hurd | |
| 3,145,505 | A | * | 8/1964 | Cornelius | |
| 3,226,935 | A | | 1/1966 | Schneller | |
| 3,320,704 | A | | 5/1967 | Forsythe et al. | |
| 3,578,733 | A | * | 5/1971 | Hurst | 52/396.02 X |
| 3,750,360 | A | * | 8/1973 | Kingston | 52/714 |
| 3,850,403 | A | | 11/1974 | Stegmeier | |
| 3,884,000 | A | * | 5/1975 | Falleij | 52/396.02 X |
| 3,998,026 | A | * | 12/1976 | Allen | 52/714 |
| 4,422,279 | A | * | 12/1983 | Powell | 52/741.47 |
| 4,524,553 | A | * | 6/1985 | Hacker | 52/169.11 |
| 5,042,218 | A | * | 8/1991 | Nasca et al. | 52/677 |
| 5,575,130 | A | * | 11/1996 | Chiodo | |
| 5,700,385 | A | * | 12/1997 | Jones | 52/677 X |
| 5,906,076 | A | | 5/1999 | McManus | |
| 6,159,399 | A | * | 12/2000 | Schmid | 264/35 |

FOREIGN PATENT DOCUMENTS

| | | | | |
|---|---|---|---|---|
| GB | 365336 | * | 1/1932 | 52/677 |

* cited by examiner

*Primary Examiner*—Robert Canfield
(74) *Attorney, Agent, or Firm*—King & Schickli, PLLC

(57) ABSTRACT

A support for holding a fluid-impervious barrier and/or keyway form in position during the pouring of concrete is provided. The support carries the barrier and a pair of spaced legs for attachment to a corresponding pair of stable mounting points, such as reinforcement members, bars or the like. The support is positioned such that the barrier is at least partially covered by concrete during the pouring of a first member, such as a slab or footing, and then the remainder is covered when a second concrete member, such as a wall, is poured atop the first member. By placing a plurality of spaced supports at selected intervals, an elongated barrier may be reliably held in place during pouring. One or more forms may also be carried by the support during the pouring of the first concrete member for defining a keyway, either alone or in conjunction with the fluid-impervious barrier. Most preferably, each keyway form is held in place by a separate wing carried on each support. A related system and method are also disclosed.

24 Claims, 6 Drawing Sheets

FLUID-IMPERVIOUS BARRIER/KEYWAY FORM SUPPORT APPARATUS, SYSTEM AND RELATED METHOD

TECHNICAL FIELD

The present invention relates generally to the construction art and, more particularly, to a support, related system, and method for holding a fluid-impervious barrier, keyway form, or both in place during the pouring of concrete.

BACKGROUND OF THE INVENTION

When forming adjacent first and second concrete members, such as a slab or footing and a corresponding upstanding wall, placing a barrier between the members to prevent a fluid, such as water, from passing is sometimes desirable. This barrier, which is commonly referred to in the art as a "water stop," is usually formed from an elongated piece of metal, fiberglass, polymer, or composite material. Typically, the barrier is held in position such that it is partially covered by concrete during the pouring of the slab or footing over the reinforcement bars. Then, when the adjacent upstanding wall is poured atop the slab or footing, the concrete surrounds and covers the remaining exposed portion of the barrier. Accordingly, in the operative position, the barrier spans between the two concrete members to provide the desired fluid-imperviousness, which is particularly desirable in forming structures such as sewers, basements, roadways, spillways, or the like.

In conventional practice, the elongated barrier is held in place at certain intervals by pairs of guide wires suspended from the reinforcement bars or a makeshift support arm cantilevered directly from the form (or optionally supported from a separate stand positioned adjacent to the form). However, there are many shortcomings associated with all of these approaches. One significant limitation is that during the pouring of the concrete, neither the wire(s) nor the cantilevered support arm provides a sufficient holding force to prevent the barrier from flopping over to one side. Left unchecked, the flopped over barrier will not be in the desired substantially vertical position during the pouring of the concrete used to form the adjacent wall or other member, and thus will not create the desired fluid-imperviousness.

A second and perhaps equally important limitation is that support wires and makeshift cantilevered support arms are both time consuming and expensive to implement. For instance, when using a cantilevered support arm, a custom-sized slot must be formed in the distal end of the arm for receiving and holding the barrier in place. If the slot is not sized properly, the barrier may slip out and fall into the concrete during the pouring of the slab or footing. Of course, a difficult fishing operation may be required to retrieve the barrier. In addition, a stand or other structure may also be necessary to support the arm, which is of course not only time consuming to construct, but also usually of limited effectiveness due to the extreme forces frequently present when concrete is poured.

A related problem arises when forming a structural keyway in a first concrete member designed for receiving a corresponding key formed in a second, adjacent concrete member. Typically, a specialized support arm must be designed and constructed for supporting the individual keyway form or forms in the first concrete member during pouring. Like the specialized cantilevered support arms or wires used in an attempt to hold the water stop or barrier securely in place, these specialized support arms are expensive and time consuming to implement, and usually are of only limited effectiveness in providing the desired support function.

Accordingly, a need is identified for an improved manner of supporting a fluid-impervious barrier, such as a water stop, or even a keyway form during the pouring of concrete to form a reinforced concrete structure. The support would be inexpensive to fabricate, easy to install, and exceedingly reliable in operation. Overall, a substantial improvement over the makeshift prior art approaches would be realized, especially in terms of reducing installation time and expense.

SUMMARY OF THE INVENTION

In accordance with the purposes of the present invention as described herein, a support for a fluid-impervious barrier or keyway, support system, and related method of forming a fluid-impervious barrier between adjacent concrete members are all provided. Advantageously, the support is designed to reduce the time required for installing a water stop/barrier, keyway form, or a combination of the two, to a matter of minutes by eliminating the need for specialized support arms cantilevered from the form, troublesome wire supports hung from the reinforcement bars or members, or other like arrangements. Despite the ease and expeditiousness with which installation is achieved, the support of the present invention provides the holding force necessary to ensure that the barrier, water stop, or other keyway form is securely and reliably held in position as the surrounding concrete is poured, The support is also fabricated of low-cost, readily available materials, thereby further reducing the overall expense associated with the installation of a water stop between adjacent concrete members.

In accordance with a first aspect of the present invention, an apparatus for assisting in supporting a fluid-impervious barrier between a pair of stable mounting points during the pouring of first and second adjacent concrete members is provided. The apparatus comprises a support including a channel portion for receiving a corresponding portion of the barrier. The support further comprises a pair of spaced leg portions, each for attachment to a corresponding one of the pair of mounting points. Thus, when attached to the mounting points, the support assists in holding the barrier in place during the pouring of the concrete members.

In one embodiment, the channel portion forming a part of the support is substantially U-shaped. The spaced leg portions are upstanding and at least partially outwardly divergent relative to the channel portion. Preferably, the mounting points are reinforcement members (bars/dowels, steel, or the like) and means for attaching each of the leg portions to the respective reinforcement members such as a tie or other fastener are also provided.

In another embodiment, and in addition to providing support for a barrier or water stop, the apparatus may also support one or more keyway forms. To do so, the support is provided with at least one, and most preferably a pair of opposing wings. These wings serve to support a portion of first and second keyway forms, such as those used to form a keyway in a first concrete member.

In accordance with a second aspect of the present invention, a system for preventing fluids from passing between first and second adjacent concrete members including a plurality of stable mounting points is provided. The system comprises an elongated substantially fluid-impervious barrier and a plurality of supports for holding the barrier in place both prior to and during the pouring of the concrete forming the first and second adjacent concrete members. Each of the supports includes a channel portion for receiving a portion of the barrier and first and second spaced leg portions, each for attachment to one of the pair of mounting points. Means for attaching each leg to the corresponding mounting point, such as a tie or other fastener, are also provided.

In one embodiment, the stable mounting points are reinforcement members provided in aligned spaced pairs, and each one of the plurality of supports is attached to an adjacent pair of reinforcement members. Also, in a preferred embodiment, each support carries at least one, and preferably a pair of wings for supporting keyway forms during the pouring of the first concrete member. Instead of wings, it should be appreciated that any attachment means, such as a tie, fastener, or the like, may be used to attach one or more keyway forms between each support (or a plurality of supports) during the pouring of the first concrete member.

In accordance with a third aspect of the present invention, a method of pouring first and second adjacent concrete members on a plurality of stable mounting points such that a substantially fluid-impervious barrier is formed therebetween is provided. The method comprises attaching a first support having a channel to a first pair of stable mounting points and attaching a second support having a channel to a second pair of stable mounting points. At least one fluid-impervious barrier is then placed between the channels of the first and second supports. Once the barrier is in place, the concrete for forming the first concrete member is poured over at least a portion of the barrier. The concrete for forming the second concrete member is then poured over a remaining portion of the barrier, either immediately after the first pouring or at some later point in time, such as after the first concrete member fully or partially cures or hardens. Accordingly, with the barrier thus in place, fluid is prevented from passing between the first and second concrete members.

In a conventional construction operation, the first concrete member is a slab or footing and the stable mounting points are reinforcement members. Accordingly, the method further includes constructing a form around the plurality of reinforcement members for containing the concrete poured to create the slab or footing. Likewise, the second concrete member is typically a wall or other upstanding structure and the method further includes constructing a form around said plurality of reinforcement members for containing the concrete poured to create the wall. However, it is within the broadest aspects of the invention for the concrete members to be formed in any shape, position, or using any known means for containing the poured concrete, as long as some form of stable mounting points, such as the sidewalls of the form, reinforcements, such as rebar, dowels, steel, grids, or the like, are provided for holding the water stop supports in place.

In addition to supporting a barrier, each support may also carry at least one, and preferably a pair of opposing wings. When these wings are present, the method further includes placing at least one keyway form between the wings such that a keyway is formed in the first concrete member during pouring. As should be appreciated, the keyway form is removed prior to pouring the second concrete member such that a key is formed therein corresponding to the keyway.

In one embodiment, each support has a pair of spaced legs, and attaching each support to the pair of stable mounting points/reinforcement members includes providing a tie for attaching each leg of the support to the corresponding mounting point/reinforcement member.

In accordance with a fourth aspect of the present invention, an assembly for assisting in supporting at least one keyway form from a pair of stable mounting points during the pouring of concrete is provided. The assembly comprises a support including a pair of spaced legs, each for attachment to a corresponding one of the pair of mounting points. Means for attaching the at least one keyway form to the support is also provided such that the support assists in holding this form in place during the pouring of the concrete. In one embodiment, the attachment means comprises at least one wing carried on the support for holding said keyway form in place. In a second embodiment, the attachment means comprises at least one tie off for tying the keyway form to the support. Preferably, as noted above, the stable mounting points are reinforcement members or bars, but the use of other types of structures for holding the support in place is also possible.

BRIEF DESCRIPTION OF THE DRAWINGS

The accompanying drawings incorporated in and forming apart of the specification illustrate several aspects of the present invention and, together with the description, serve to explain the principles of the invention.

In the drawings.

Reference will now be made in detail to the present preferred embodiment of the invention, an example of which is illustrated in the accompanying drawing.

DETAILED DESCRIPTION OF THE INVENTION

Figure 1:
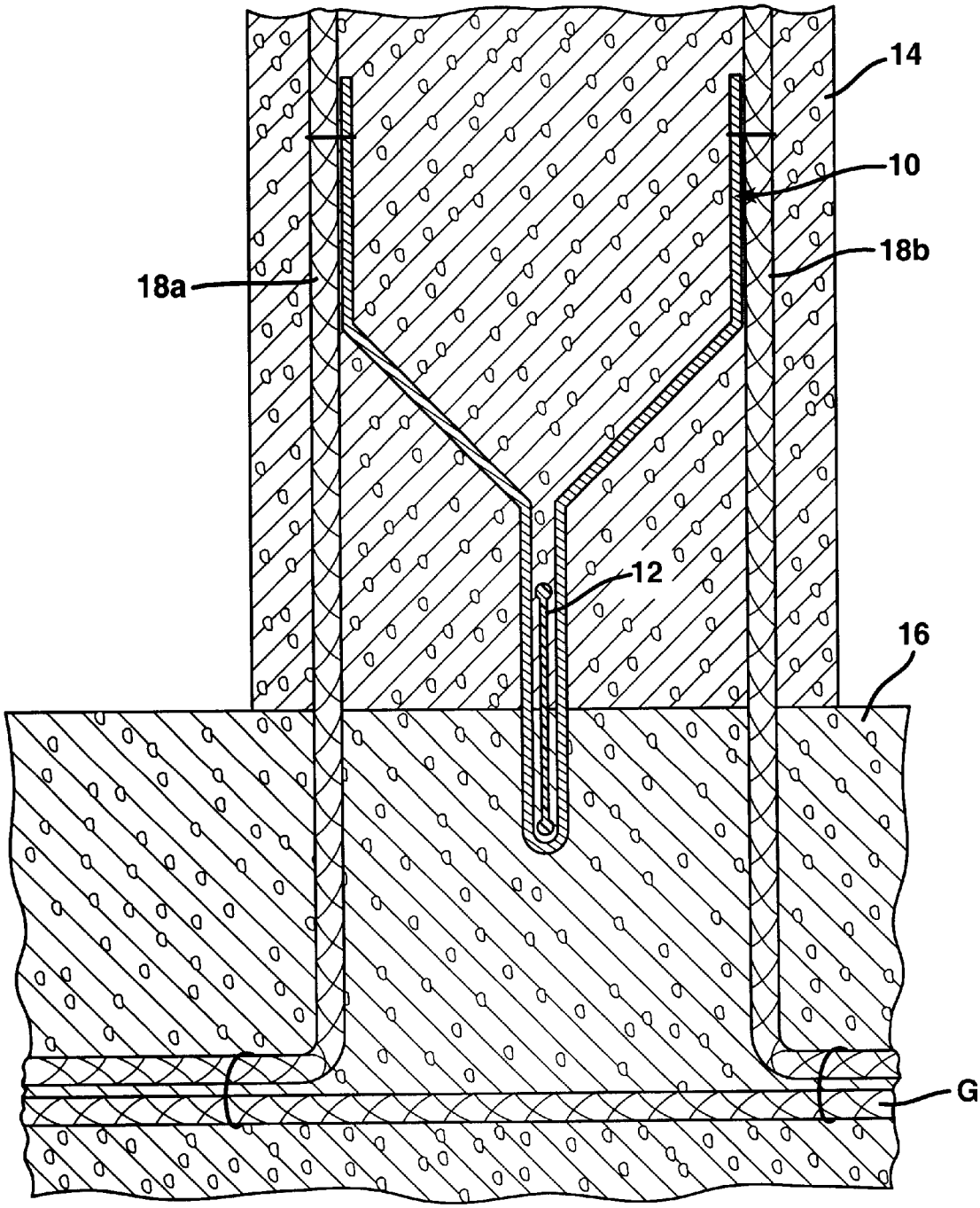
FIG. 1 is a cross-sectional side view of first and second adjacent concrete members with a barrier, such as a water stop, held in place between the two members by one embodiment of the support of the present invention.
Figure 2:
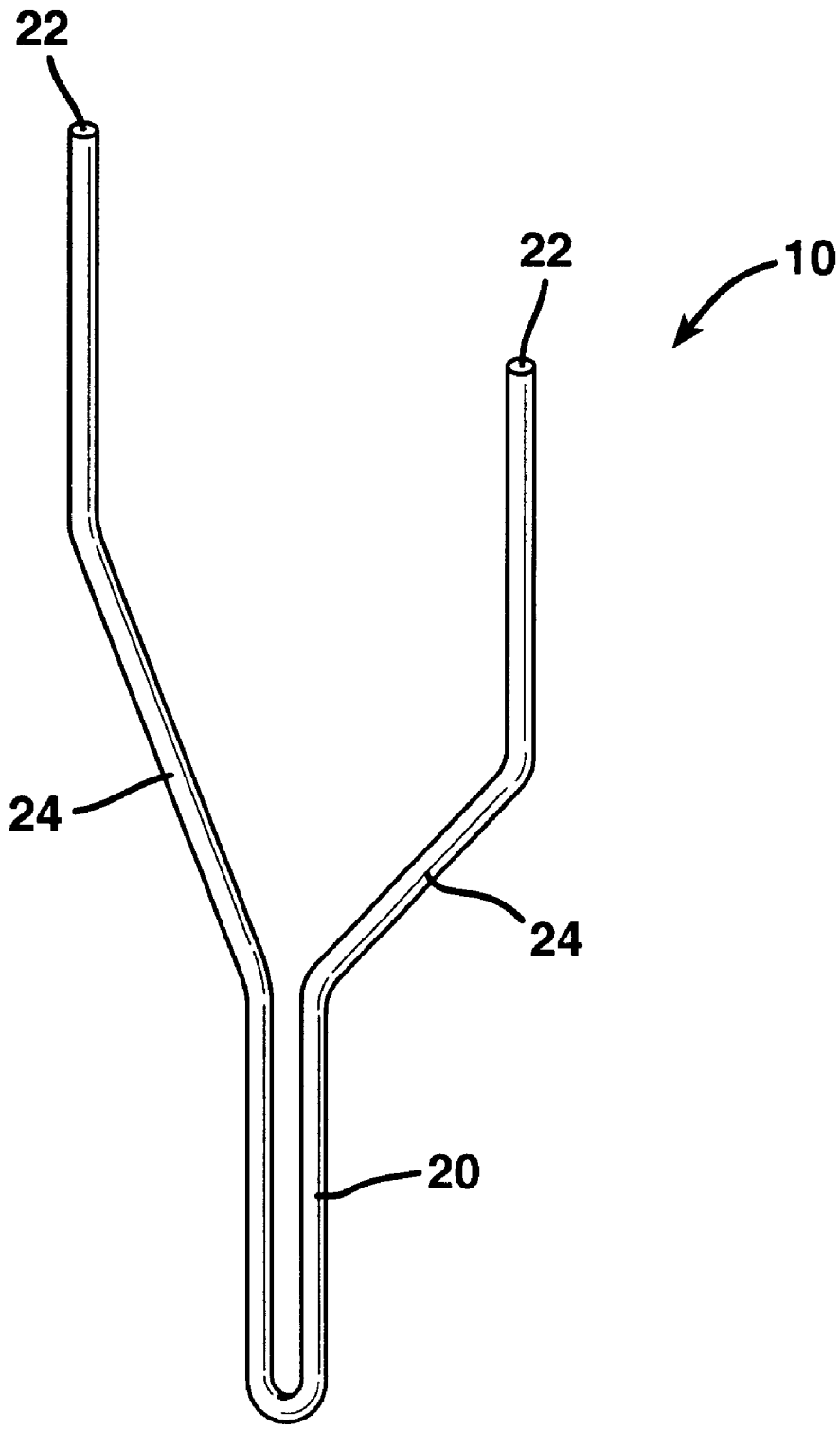
FIG. 2 is a perspective view of the support forming part of the present invention.
Figure 3:
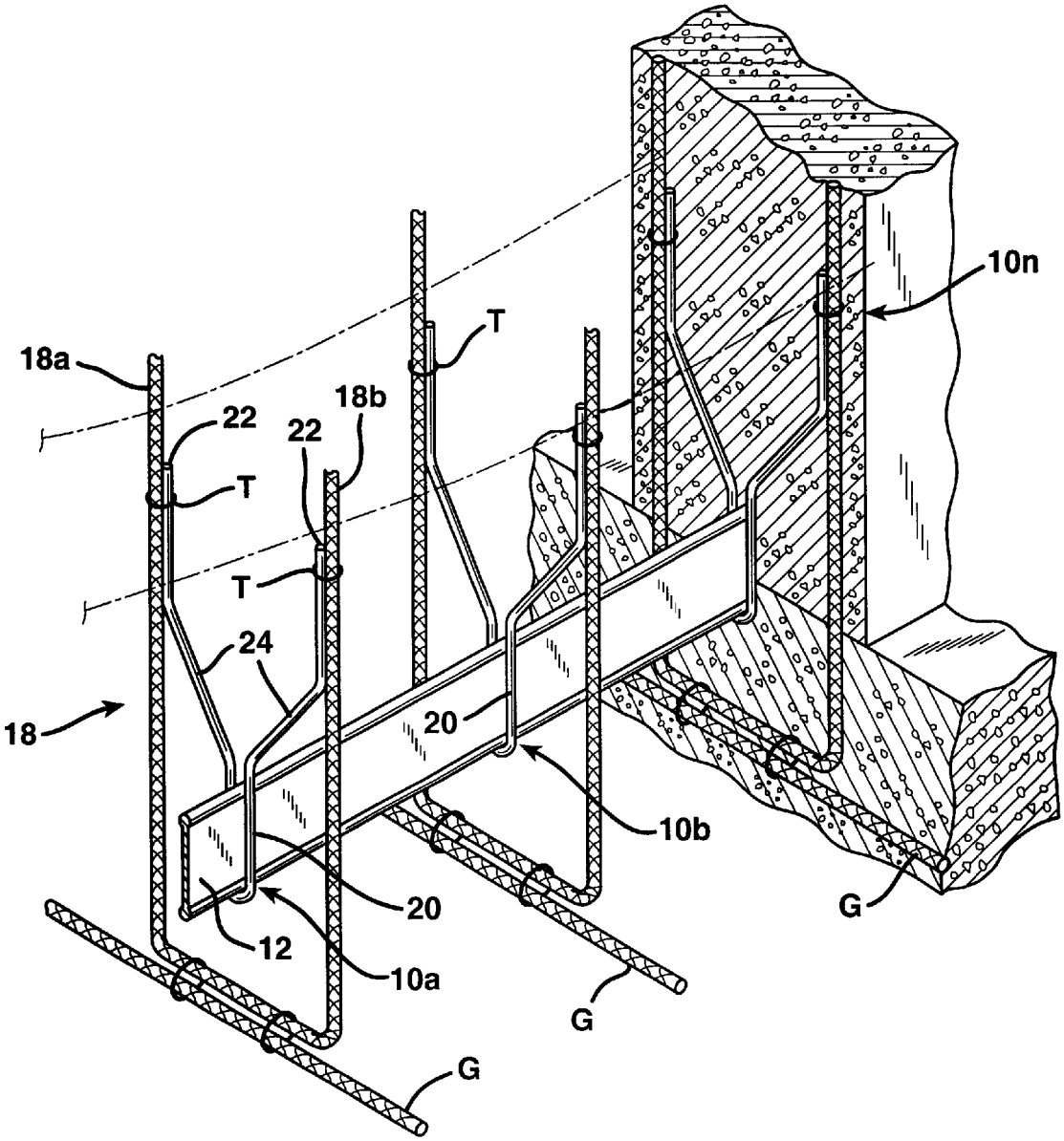
FIG. 3 is a partially cross-sectional perspective view showing the manner in which the water stop is held in place both prior to and after the concrete is poured.

Reference is now made to FIGS. 1–3, which shows one embodiment of the support 10 of the present invention used to hold a fluid-impervious barrier, such as a water stop 12, in place between first and second concrete members 14, 16, both prior to and during pouring of the concrete. Of course, in the embodiment shown in FIG. 1, the concrete forming each first and second member 14, 16 has already been poured over the reinforcement "steel," which typically is comprised of reinforcement bars 18, or "rebar." These bars 18 are commonly upstanding and provided in spaced and aligned pairs 18*a*, 18*b*. Reinforcement members in the form of steel bars are well-known in the art and are usually supported by an overall horizontal grid G (only one transversely extending member shown in FIGS. 1 and 3) that provides support for the upstanding reinforcement bars 18*a*,

18*b* and often provides the structural framework for the slab or footing being poured.

Figure 4:
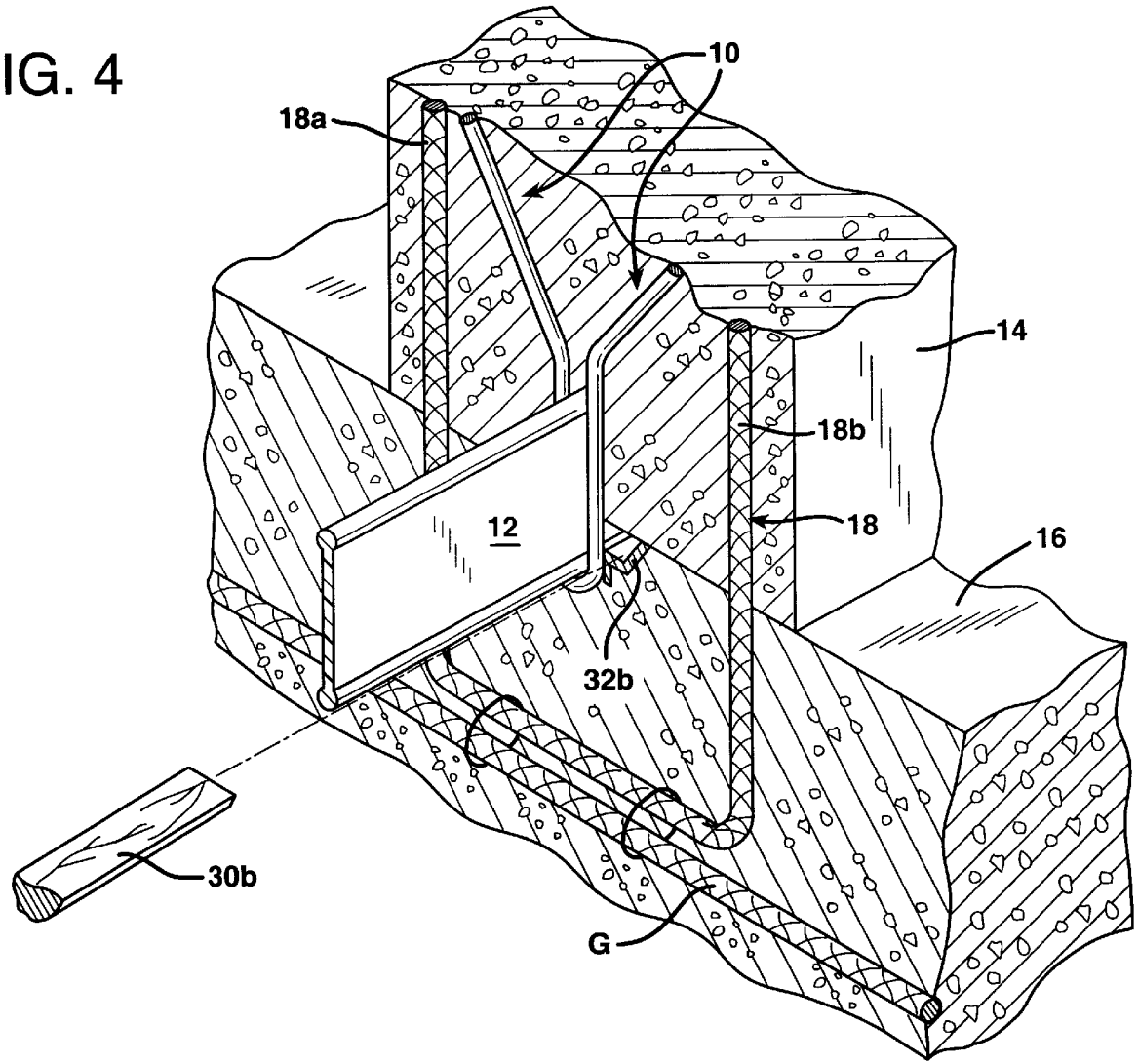
FIG. 4 is a perspective view of an alternate embodiment wherein the support carries first and second side wings for receiving keyway forms that are removed after the concrete poured for the first member sets or hardens.
Figure 5:
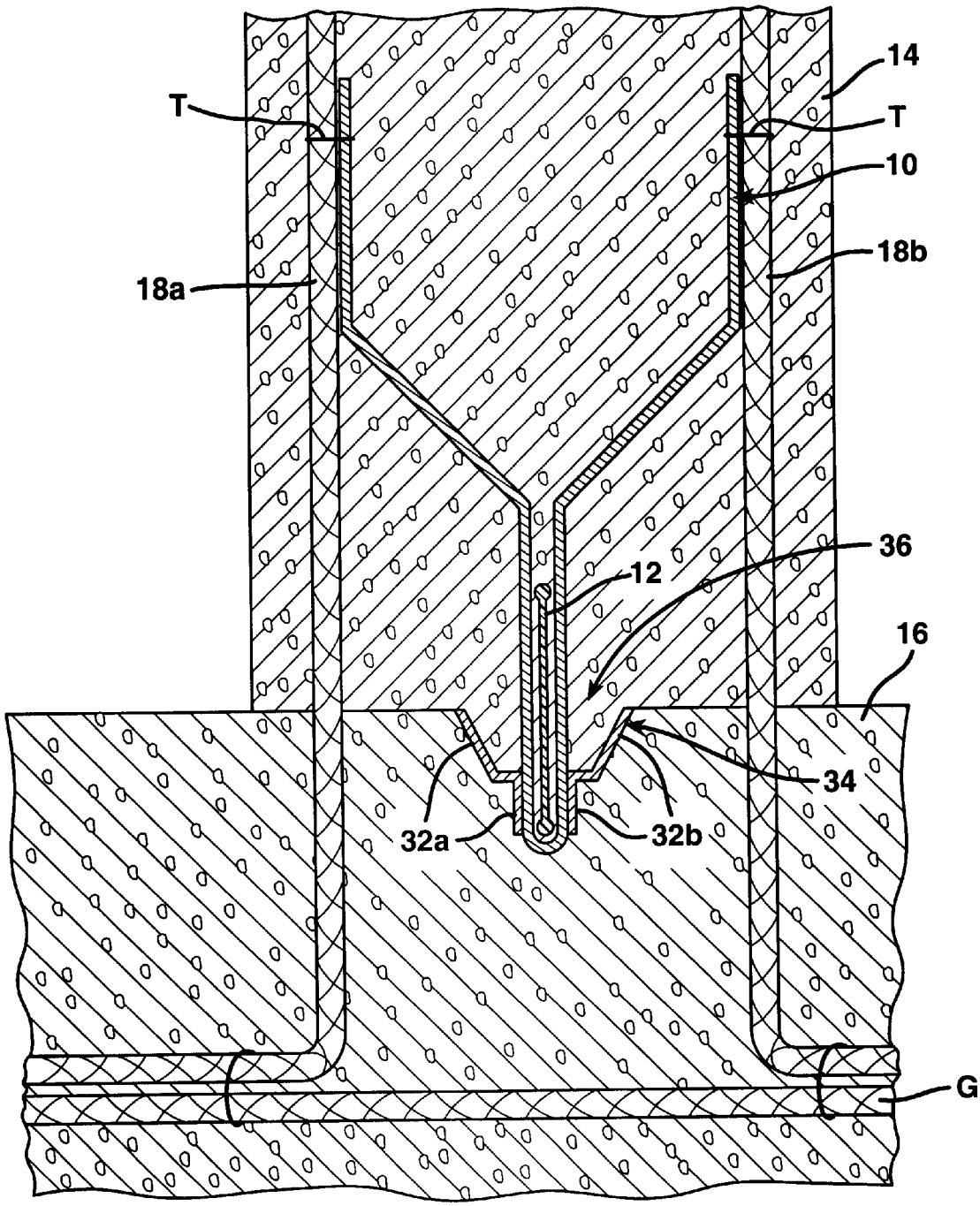
FIG. 5 is a cross-sectional side view of the alternate embodiment shown in FIG. 4 with the keyway forms removed.

The pair of upstanding rebar members 18*a*, 18*b* may be separate L-shaped members, as shown in FIGS. 1 and 5, but may also be formed together as unitary U-shaped structures, as shown in FIGS. 3 and 4. In either case, the rebar members 18*a*, 18*b* are usually attached to the adjacent member forming the horizontal grid G at the lower end using ties or other attachment means, and are attached in a similar fashion to longitudinally extending members at the upper ends (see dot-dash lines in FIG. 3). Of course, the present invention may be used in conjunction with other equivalent arrangements, such as when the reinforcement bars 18*a*, 18*b* are spaced far apart, angled, or even replaced with other types of reinforcing "steel," such as a unitary grid or other reinforcement structure.

Typically, forms (not shown) are provided around the reinforcement bars 18*a*, 18*b* constructed from a plurality of wooden members. These forms serve to contain the concrete during pouring and define its shape upon hardening. Although the use of wood is preferred for its relatively low cost, the forms may be fabricated of any materials that contain the concrete and can be arranged as necessary to create a wide variety of concrete shapes. In conventional construction, however, a lower form often surrounds the members forming the horizontal grid G and the lower portion of the rebar members 18*a*, 18*b* to define a relatively wide slab or footing as a base member, such as first member 14, while a second form surrounds the upstanding portion of members 18*a*, 18*b* to define a relatively narrow upstanding wall or similar structure, such as second member 16.

One most preferred embodiment of the support 10 of the present invention is best shown apart from the concrete members 14, 16 in FIG. 2. The support 10 includes a substantially U-shaped channel portion 20 and a pair of upstanding leg portions 22. The leg portions 22 are preferably outwardly divergent relative to the channel 20 as the result of angled connecting portions 24. Preferably, the angle formed by the connecting portions 24 with the horizontal is about 45°, but the use of greater or lesser angles is of course possible to vary the shape or the relative dimensions of the other portions. For instance, the angle could be from 0° to 90° relative to the horizontal plane, and could even be negative such that the channel portion 20 is positioned above the ends of the leg portions 22 in the vertical plane.

To lessen the time and expense required for fabricating the support 10, it should be appreciated that it may be formed of a single piece or bar of material bent to define the U-shaped channel portion 20, the upstanding legs 22, and the connecting portions 24. Of course, the relative dimensions or shape of the bar used may vary, as may the composition of the material used to fabricate the support 10. However, it is preferable to use a high strength, low cost, moderate weight steel, such as that typically used to form the reinforcement bars 18*a*, 18*b*.

In operation, and as perhaps best understood with reference to FIG. 3, each leg portion 22 is attached to a corresponding reinforcement bar 22*a*, 22*b* or other member provided in or adjacent to the form. Preferably, this attachment is completed by simply using a wire, rope, or other form of tie T. However, the use of mechanical fasteners, tape, adhesives, or even spot welds is possible, along with any other means that provides the desired attachment function.

Preferably, the supports 10 are attached to selected rebar members 18*a*, 18*b* at spaced intervals, such as those positioned every few feet or so. Usually, the spacing is selected depending on the particular spacing of the rebar members 18*a*, 18*b*, the type and length of barrier or water stop 12 employed, the weight and composition of the concrete, or other factors that vary from job to job. In FIG. 3, the supports 10 are shown attached to each successive pair of rebar members 18*a*, 18*b* for purposes of illustration only. As described further below, the vertical positioning of each support 10 along the rebar members 18*a*, 18*b* will depend on the height of the water stop 12 and the desired vertical extent of the first concrete member 14, both of which are a matter of design choice.

Once a plurality of the supports 10*a*, 10*b*, . . . 10*n* are in place, the water stop 12 is placed in the channel 20 of each. The water stop 12 is typically formed of a substantially fluid impermeable material, such as metal, fiberglass, polymers, or composite materials. Such types of water stops are well known in the art. Preferably, the supports 10 are positioned in the vertical plane such that about one-half of the height of the water stop 12 is covered by the concrete during the pouring of the first member 14, such as the slab or footing (that is, the vertical midpoint of the water stop 12 is preferably aligned with the anticipated horizontal upper surface of the slab). Depending on the size of the channel portion 20 relative to the water stop 12, spacers or ties (not shown) may be used to prevent the stop from shifting from side-to-side. As should be appreciated, the use of these optional spacers or fasteners also promotes the encasement of the major portion of the barrier held in the channel portion 20.

Once the water stop 12 is in place, the concrete is poured to form the first concrete member 14. Preferably, this concrete covers about half of the water stop 12 in the vertical dimension and a corresponding portion of each support 10*a* . . . 10*n*. As is known in the art, it may then be necessary to allow the concrete forming the first member 14 to partially harden prior to pouring the second member 16, but in some cases pouring may begin immediately. In either case, the remaining concrete when poured serves to cover the exposed portion of the water stop 12 and support 10. However, it should be appreciated that the water stop 12 is advantageously prevented from flopping over or moving from side-to-side along its entire length by the plurality of supports 10*a* . . . 10*n*, and more particularly the channel portion 20 of each support constructed in accordance with this most preferred embodiment.

When the concrete hardens, an interface is formed between the first and second members 14, 16. Without a water stop 12 or similar barrier, fluids may pass through this interface, which is of course undesirable for certain applications. However, as a result of the strategic placement of the water stop 12 or other barrier between the members 14, 16 during pouring, fluids such as water are fully prevented from passing through this interface. As is known in the art, this fluid-imperviousness is particularly advantageous for constructing sewers, basements, or other concrete structures where fluid is to be contained or kept out.

In an alternate embodiment, as shown in FIGS. 4 and 5, the support 10 may also be used to support one or more keyway forms 30*a*, 30*b* in addition to a water stop 12 or other fluid-impervious barrier. In a most preferred version of this embodiment, first and second pairs of wings 32*a*, 32*b* are carried by each support 10. By aligning the wings 32*a*, 32*b* on each side of the support 10 in the vertical plane, a keyway form 30*a* or 30*b* may be placed on each such that it spans between a plurality of supports 10. In one embodiment, each wing 32*a* or 32*b* is formed of a relatively short piece of rebar welded directly to the support 10 adjacent to the channel portion 20 prior to installation. Preferably, the rebar forming the wing 32*a* or 32*b* is bent to cradle the corresponding form 30*a* or 30*b*.

Typically, the forms 30*a*, 30*b* are made from elongate wooden members that are cut to correspond to the size and shape of key that is desired between two adjacent concrete members (see below). To ensure that the members are held in place during pouring, the wings 32*a*, 32*b* may be provided with cleats or the like (not shown). Alternatively, ties or other fasteners may be used (not shown).

In use, the concrete for the first member 14 is poured substantially as described above, with the keyway forms 30*a*, 30*b* being removed once the concrete hardens (compare FIGS. 4 and 5). As should be appreciated, upon removing these forms 30*a*, 30*b*, a keyway 34 is thus defined in the hardened concrete forming the slab or footing. Then, the second member 16 is poured as described above (shown as already poured in FIG. 4), with any concrete filling the keyway 34 to form a corresponding key 36 that upon hardening prevents lateral shifting. Of course, even with this key/keyway arrangement, any fluid is still prevented from passing though any interface present by the strategically placed water stop 12, which is in fact partially surrounded by the concrete forming the key 36.

Figure 6:
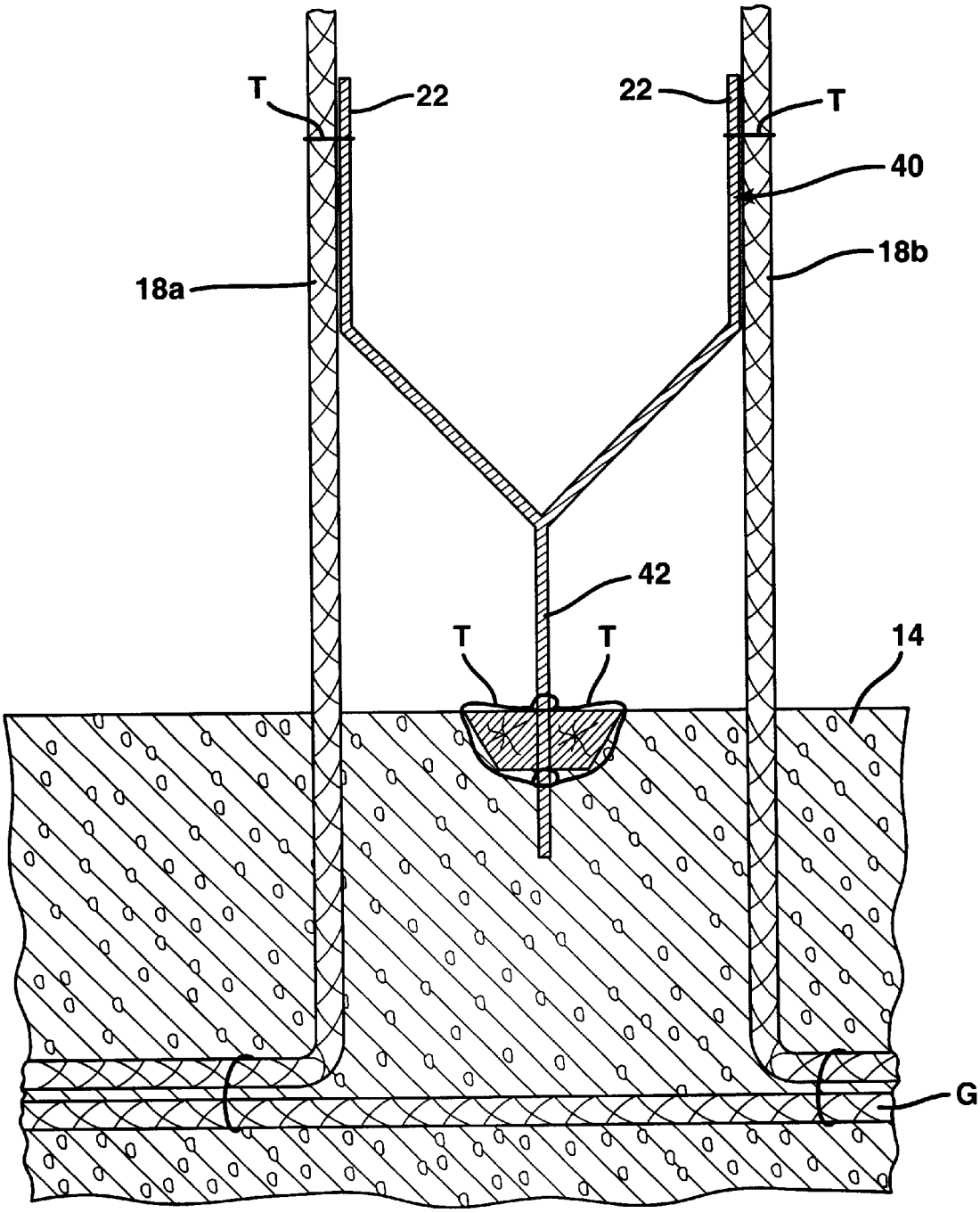
FIG. 6 is a variation on the alternate embodiment wherein the keyway forms are attached to the support by ties and then removed after the concrete poured for the first member sets or hardens.

In yet another alternate embodiment, a version of which is shown in FIG. 6, a support 40 for a keyway form 30*a* or 30*b*, alone or even a water stop alone (not shown), may be provided. The support 40 may be constructed substantially as described above, but the channel portion 20 may be narrowed or even eliminated in favor of a single depending member 42, such that the support 40 is substantially Y-shaped in the most preferred embodiment. The leg portions 22, whether upstanding, parallel to the horizontal plane, or depending, are then attached to the rebar members 18*a*, 18*b* or the like using ties, fasteners, or other attachment means. The keyway form(s) 30*a* or 30*b* (or the water stop) is then attached directly to the supports 10 using attachment means, which may be a separate tie T or a wing 32*a* or 32*b* as described above, or any other form of fastener. The pouring of the first member 14 then proceeds substantially as described above, with the form(s) 30*a* or 30*b* being removed prior to the pouring of the second member 16 such that the desired key/keyway arrangement is provided.

The foregoing description of a preferred embodiment of the present invention has been presented for purposes of illustration and description. It is not intended to be exhaustive or to limit the invention to the precise form disclosed. Obvious modifications or variations are possible in light of the above teachings. For instance, it is again emphasized that the channel portion 20 and leg portions 22 may be arranged in configurations and with relative dimensions other than those shown in the attached drawing figures. Moreover, it is possible that the leg portions 22 could depend from the channel portion 20, or even extend parallel thereto, without departing from the broadest aspects of the apparatus, system, and method of the present invention. Also, instead of reinforcement "steel" (i.e., rebar or the like), any stable mounting point could hold the support 10 in the operative position, including the sidewalls provided by any form present or other structure. The particular embodiments shown and described were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An apparatus for assisting in supporting a fluid-impervious barrier between a pair of stable mounting points during the pouring of first and second adjacent concrete members, comprising:

a support including a U-shaped receiver having closely spaced, generally parallel side portions extending in a generally vertical direction and capable of receiving supporting, and maintaining a portion of the barrier in a position generally parallel to said side portions, a pair of spaced leg portions extending in a generally vertical direction, each for attachment to a corresponding one of said pair of stable mounting points, and a pair of intermediate portions connecting each side portion of the receiver to one of the leg portions, wherein the intermediate portions diverge outwardly from each other and extend at an acute angle relative to a horizontal plane;

whereby said support assists in holding the barrier in place during the pouring of the concrete members.

2. The apparatus according to claim 1, wherein said stable mounting points are reinforcement members.

3. The apparatus of claim 1, wherein the acute angle is about 45° and each intermediate portion extends upwardly relative to the horizontal plane.

4. The apparatus of claim 1, wherein the acute angle is about 45° and each intermediate portion extends downwardly relative to the horizontal plane.

5. The apparatus according to claim 1, further including means for attaching each of said leg portions to the respective stable mounting point.

6. The apparatus according to claim 1, further including at least one wing carried by said support for supporting a keyway form.

7. The apparatus according to claim 1, further including a pair of opposing first and second wings carried by said support for supporting corresponding first and second keyway forms.

8. A system for preventing fluids from passing between first and second adjacent concrete members including a plurality of stable mounting points, comprising:

an elongated substantially fluid-impervious barrier;

a plurality of supports for holding said barrier in place both prior to and during the pouring of the concrete forming said first and second adjacent concrete members, at least one of said supports including a channel portion for receiving a portion of said barrier and at least one leg portion for attachment to one of said plurality of stable mounting points; and means for attaching said at least one leg portion to the corresponding stable mounting point.

9. The system according to claim 8, wherein each stable mounting point is a reinforcement member and the attaching means is a tie.

10. The system according to claim 8, wherein said plurality of stable mounting points are reinforcement members provided in aligned spaced pairs, and each one of said plurality of supports includes first and second leg portions that are attached to one of an adjacent pair of said reinforcement members.

11. The system according to claim 8, further including at least one wing carried on said support for supporting a keyway form during the pouring of said first concrete member.

12. The system according to claim 8, further including a pair of opposing first and second wings carried on said support for supporting corresponding first and second keyway forms during the pouring of said first concrete member.

13. The system according to claim 8, further including at least one means for attaching at least one keyway form to said support during the pouring of said first concrete member.

14. The system according to claim 13, wherein said keyway form attaching means is a tie.

15. A method of pouring first and second adjacent concrete members such that a substantially fluid-impervious barrier is formed therebetween, comprising:

attaching a first support having a channel to a first pair of stable mounting points;

attaching a second support having a channel to a second pair of stable mounting points;

placing at least one fluid-impervious barrier between the channels;

pouring the concrete for forming the first concrete member over at least a portion of said barrier; and pouring the concrete for forming the second concrete member over a remaining portion of said barrier, whereby fluid is prevented from passing between said first and second concrete members by said barrier.

16. The method according to claim 15, wherein said first concrete member is a slab or footing, said stable mounting points are reinforcement members, and said method further includes constructing a form around said plurality of reinforcement members for containing the concrete poured to create the slab or footing.

17. The method according to claim 16, wherein said second concrete member is a wall and said method further includes constructing a form around said plurality of reinforcement members for containing the concrete poured to create the wall.

18. The method according to claim 15, wherein each said support carries at least one wing, and said method further includes placing at least one keyway form between said wings such that a keyway is formed in the first concrete member during pouring.

19. The method according to claim 18, wherein the keyway form is removed prior to pouring the second concrete member such that a key is formed therein corresponding to the keyway.

20. The method according to claim 15, wherein each said support carries a pair of opposing wings, and said method further includes:

placing a first keyway form between the corresponding wings on a first side of the first and second supports and a second keyway form between the corresponding wings on a second side of the first and second supports such that a keyway is formed in the first concrete member during pouring;

removing the first and second keyway forms prior to pouring the second concrete member to expose the keyway thus formed.

21. The method according to claim 15, wherein each said support has a pair of spaced legs, and attaching each said support to said pair of stable mounting points includes providing a tie for attaching each leg of the support to the corresponding mounting point.

22. An assembly for assisting in supporting at least one keyway form or barrier from a pair of stable mounting points during the pouring of concrete, comprising:

a generally Y-shaped support including a pair of spaced legs, each for attachment to a corresponding one of said pair of mounting points; and at least one wing carried on the support for holding the keyway form or barrier in place;

whereby said support assists in holding the keyway form or barrier in place during the pouring of the concrete.

23. The assembly according to claim 22, wherein the stable mounting points are reinforcement members.

24. An assembly for assisting in supporting at least one keyway form or barrier from a pair of stable mounting points during the pouring of concrete, comprising:

a generally Y-shaped support including a pair of spaced legs, each for attachment to a corresponding one of said pair of mounting points;

at least one tie for tying the keyway form or barrier to said support; and whereby said support assists in holding the keyway form or barrier in place during the pouring of the concrete.

* * * * *